US005532807A

United States Patent [19]

Takemoto

[11] Patent Number: 5,532,807

[45] Date of Patent: Jul. 2, 1996

[54] HEATING ROLLER HAVING ELECTRODES FOR SUPPLYING POWER TO A HEATING ELEMENT

[75] Inventor: Takeshi Takemoto, Yamato, Japan

[73] Assignee: Ricoh Company, Ltd., Tokyo, Japan

[21] Appl. No.: 362,789

[22] Filed: Dec. 23, 1994

[30] Foreign Application Priority Data

Dec. 27, 1993 [JP] Japan ..... 5-329163

[51] Int. Cl.[6] ..... G03G 15/20

[52] U.S. Cl. ..... 355/289; 219/216; 219/471; 439/25

[58] Field of Search ..... 355/285, 290, 355/289; 219/216, 469, 470, 471; 338/332; 439/13, 18, 23–26, 28, 29; 310/249, 71

[56] References Cited

FOREIGN PATENT DOCUMENTS 55-164860 12/1980 Japan .

*Primary Examiner*—Joan H. Pendegrass

*Attorney, Agent, or Firm*—Oblon, Spivak, McClelland, Maier & Neustadt

[57] ABSTRACT

In a heating roller, electrode members come in contact with power supplying members for supplying power to a heating element. The electrode members are resiliently fitted to the heating element. Power is supplied from the power supplying members to the heating element through the electrode members. In this heating roller, it is possible to solve problems about cracks, etc. caused by thermal expansion, etc. of each of the heating element, the electrode members and an electric conductor formed by materials having different coefficients of thermal expansion. Accordingly, reliability of the heating roller is high and the heating roller is safe. The heating roller may have a bearing for rotatably supporting the heating roller; a structural member for supporting the bearing; and a rotating force transmitting member arranged in an electrode member resiliently fitted to the heating element or arranged in a conductive resilient member between the heating element and the electrode member so that rotating force of the heating roller is obtained from the exterior thereof.

5 Claims, 6 Drawing Sheets

HEATING ROLLER HAVING ELECTRODES FOR SUPPLYING POWER TO A HEATING ELEMENT

BACKGROUND OF THE INVENTION

1. Field of the Invention

The present invention relates to a heating roller arranged in a fixing device used in an image forming apparatus such as an electrophotographic apparatus, etc.

2. Description of the Related Art

A fixing method used in an image forming apparatus is classified into three systems of thermal fixation, pressure fixation and solvent fixation. The thermal fixation is used in an electrophotographic apparatus. For example, in the structure of a fixing device for performing such thermal fixation, a heating roller and a pressurizing roller are arranged such that the heating and pressurizing rollers are opposed to each other through a paper sheet conveying path and are rotatably supported and come in press contact with each other by a spring, etc. Toner transferred onto a sheet of printing paper is heated and melted by heat of the heating roller. The pressurized and melted toner is fixed onto the printing paper sheet when the paper sheet is conveyed between the heating and pressurizing rollers. Accordingly, the heating roller simultaneously heats and conveys the printing paper sheet so that the image forming apparatus can be made compact and light in weight.

In many cases, the heating roller generally has a structure in which a heating resistor formed in the shape of a shaft is arranged within a metallic roller having a circular tube shape. However, thermal efficiency of the heating roller is low in this structure so that it is difficult to save power and improve responsibility, etc. Therefore, for example, Japanese Patent Application Laying Open (KOKAI) No. 55-164860 proposes a fixing device of a surface heating type in which a surface of the heating roller is formed by a heating resistor.

In this proposed fixing device, the surface heating roller is constructed such that a pair of electrode members of a power receiving portion are arranged on outer circumferential faces of both end portions of the surface heating roller. This surface heating roller is arranged on a paper sheet conveying path such that the surface heating roller is rotatably supported between body frames. A pair of electricity-flowing brushes of a transmission section connected to a power source on an unillustrated body side of the fixing device are resiliently mounted to the body frames by springs respectively arranged on inside faces of the body frames. The electricity-flowing brushes respectively come in contact with the electrode members of the surface heating roller.

In the fixing device having such a construction, the electricity-flowing brushes respectively come in contact with the electrode members arranged through electric conductors on the outer circumferential faces of the heating roller by resilient force of each of the springs. Therefore, power is supplied from the body power source to the rotating heating roller. The heating roller is heated by this supplied power so that toner on a printing paper sheet sequentially conveyed by rotating the heating roller is heated and fixed onto this printing paper sheet.

In many cases, the heating resistor, the electrode members and the electric conductors of the heating roller are formed by different materials. Differences between coefficients of thermal expansion of these constructional elements are relatively large. For example, when the heating resistor is mainly constructed by $Al_2O_3$ having dispersed NiCr ranging from 25 to 30%, the coefficient of thermal expansion of this heating resistor is equal to $9\times10^{-6}/°$ C. When the electrode members are constructed by a CuAl alloy, the coefficient of thermal expansion of each of these electrode members is equal to $20\times10^{-6}/°$ C. Accordingly, there is a fear of causing a crack between a heating resistor layer and the electric conductors, between the electric conductors and the electrode members, or between the heating resistor and the electrode members on the heating roller repeatedly heated and cooled. Therefore, there are fears of generation of a spark and a conductive break by discharge from a portion of this crack. In particular, such fears are strong in an environment in which a high voltage power source is used in countries such as Europe, United States of America, etc.

SUMMARY OF THE INVENTION

It is therefore an object of the present invention to provide a reliable and safe heating roller for solving problems about cracks, etc. caused by thermal expansion, etc. of each of a heating element, an electrode member and an electric conductor formed by materials having different coefficients of thermal expansion.

In accordance with a first construction of the present invention, the above object can be achieved by a heating roller comprising a heating element; and an electrode member coming in contact with a power supplying member for supplying power to the heating element and resiliently fitted to the heating element; power being supplied to the heating element by the electrode member and the power supplying member.

In accordance with a second construction of the present invention, the above object can be also achieved by a heating roller comprising a heating element; and a resilient member having a conductive property and arranged between the heating element and an electrode member; power being supplied to the heating element by the electrode member and a power supplying member.

In accordance with a third construction of the present invention, the above object can be also achieved by a heating roller comprising a heating element; a bearing for rotatably supporting the heating roller having the heating element; a structural member for supporting the bearing; and a rotating force transmitting member arranged in an electrode member resiliently fitted to the heating element, or arranged in a resilient member having a conductive property between the heating element and the electrode member so that rotating force of the heating roller is obtained from the exterior thereof; a movement of the heating roller in a thrust direction being restricted by making the structural member or the bearing come in contact with the electrode member or the resilient member.

In the first construction of the present invention, power is supplied from the power supplying member to the heating element through the electrode member resiliently fitted to the heating element. Accordingly, a change in size of each of the heating element and the electrode member caused by thermal expansion caused by heat of the heating element, thermal expansion of the electrode member, etc. is absorbed by the electrode member.

In the second construction of the present invention, a change in size of each of the heating element and the electrode member caused by thermal expansion is absorbed by the resilient member having a conductive property and arranged between the heating element and the electrode member.

In each of the first to third constructions of the present invention, it is possible to provide a reliable and safe heating roller for solving problems about cracks, etc. caused by thermal expansion, etc. of each of the heating element, the electrode member and an electric conductor formed by materials having different coefficients of thermal expansion.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a heating roller in the present invention will next be described in detail with reference to the accompanying drawings.

Figure 1:
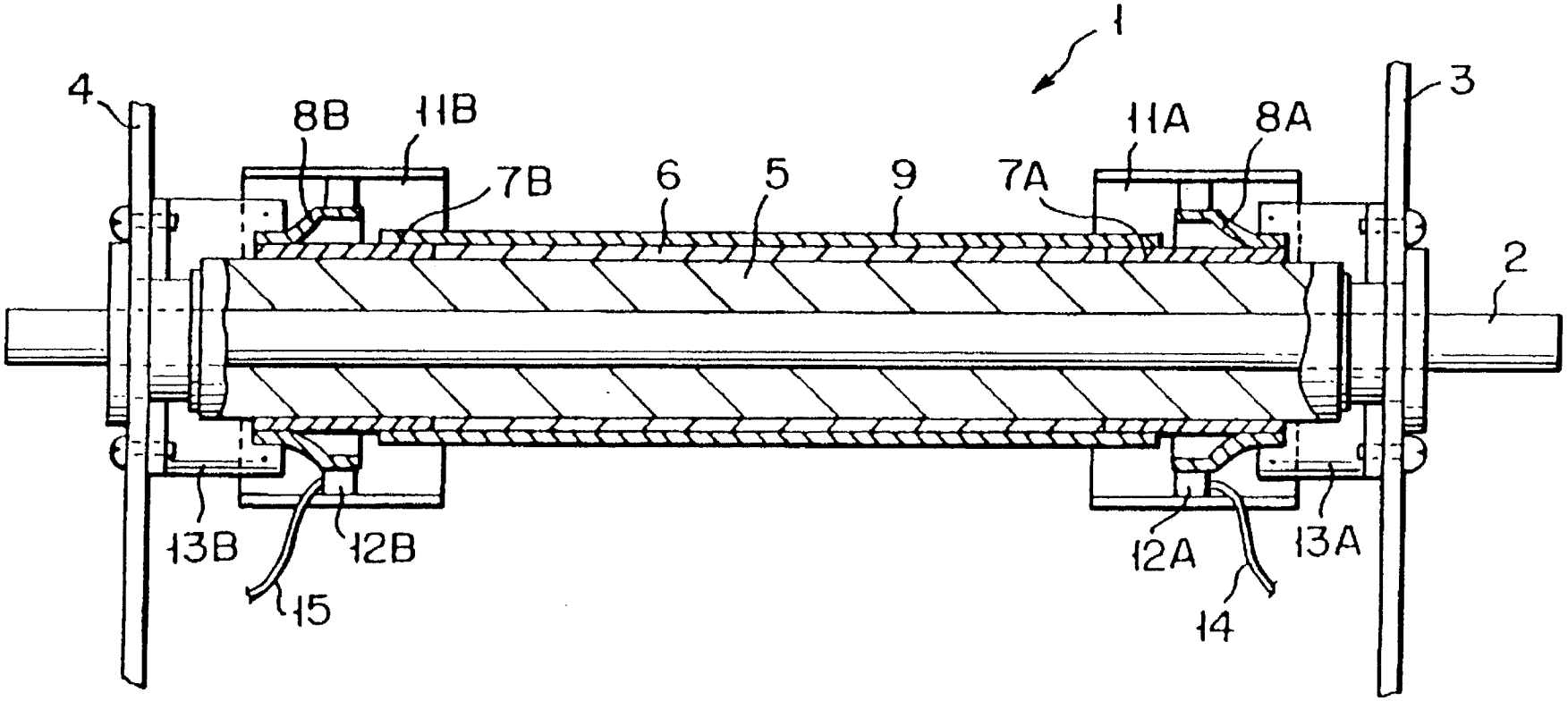
FIG. 1 is a cross-sectional view schematically showing the construction of a heating roller in accordance with a first embodiment of the present invention.

A heating roller in accordance with a first embodiment of the present invention will first be explained. In FIG. 1, a heating roller 1 is rotatably supported by a supporting shaft 2 with respect to side plates 3 and 4. The heating roller 1 is mainly constructed by a core body 5 fixed to the supporting shaft 2, a heating resistor 6 wound around an outer circumference of the core body 5, electrode layers 7A, 7B as a pair of electric conductors, and electrode members 8A, 8B. The core body 5 is made of ceramic molded in a cylindrical shape. A central portion of an outer circumferential face of this core body 5 is covered with the heating resistor 8. The electrode layers 7A and 7B are fixed to both ends of the core body 5 such that the electrode layers 7A and 7B come in contact with both sides of the heating resistor 6. The heating resistor 6 is formed by $Al_2O_3$ having dispersed NiCr ranging from 25 to 30%. Each of the electrode members 8A and 8B is formed by a CuAl alloy.

An insulating protective layer 9 is formed on the heating resistor 6 and the electrode layers 7A and 7B except for one portions of the electrode layers 7A and 7B. The insulating protective layer 9 has insulating, protecting and mold-releasing properties. This insulating protective layer 9 is generally formed by coating of Teflon (trade name).

Figure 2:
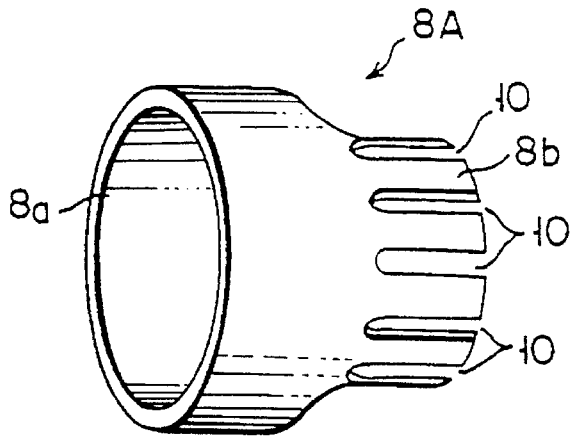
FIG. 2 is a perspective view showing an electrode member in the first embodiment.

The pair of electrode members 8A and 8B are molded in the same shape and are respectively press-fitted onto the portions of the electrode layers 7A and 7B in which no insulating protective layer 9 is formed. In the following description, the heating roller will be explained by using the electrode member 8A shown in FIG. 2. The electrode member 8A is approximately formed in a cylindrical shape. A large diameter portion 8*a* of the electrode member 8A is set to be larger than a diameter of the core body 5 covered with the electrode layer 7A. A small diameter portion 8*b* of the electrode member 8A is set to be smaller than the diameter of the core body 5 covered with the electrode layer 7A. A plurality of slits 10 extend in a direction of a generating line of the electrode member 8A and are spaced from each other along a circumferential direction in the small diameter portion 8*b* of the electrode member 8A. The slits 10 are used to resiliently mount the electrode member 8A to the electrode layer 7A. The electrode member 8A is preferably formed by using a metal having conductive and resilient properties such as phosphor bronze, etc.

Figure 3:
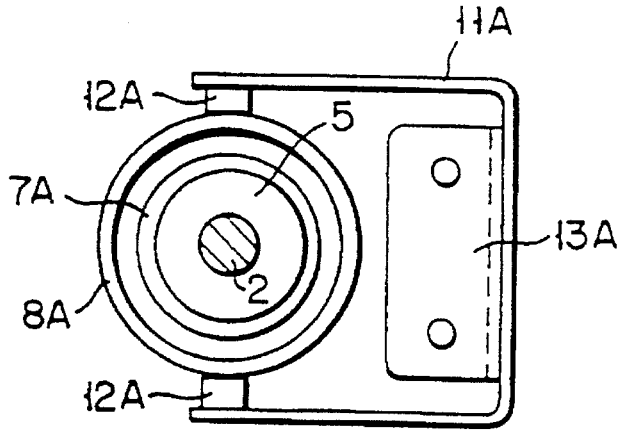
FIG. 3 is a cross-sectional view of the heating roller shown in FIG. 1.

Carbon brushes 12A and 12B fixed to leaf springs 11A and 11B and constituting a power supplying member respectively come in contact with outer circumferential faces of the electrode members 8A and 8B shown in FIG. 1. Each of the leaf springs 11A and 11B is formed in a U-shape in cross section (see FIG. 3). The carbon brushes 12A and 12B fixed onto inside faces of the leaf springs 11A and 11B resiliently come in slide contact with the respective electrode members 8A and 8B by the leaf springs 11A and 11B. As shown in FIG. 3, the leaf springs 11A and 11B are respectively fixed to the side plates 3 and 4 through brackets 13A and 13B. Lead wires 14 and 15 are respectively connected to the carbon brushes 12A and 12B and are also connected to a power source of an unillustrated device body. With respect to the heating roller 1 constructed above, when the power source of the unillustrated device body is turned on, an electric current flows to the heating resistor 6 from the carbon brushes 12A, 12B through the electrode members 8A, 8B and the electrode layers 7A, 7B. Thus, the heating resistor 6 is heated. At this time, the electrode members 8A, 8B and the electrode layers 7A, 7B are also heated. Accordingly, thermal expansion is caused between the electrode members 8A, 8B and the electrode layers 7A, 7B. However, this thermal expansion is absorbed by the electrode members 8A and 8B having elasticity.

Accordingly, it is possible to reduce generation of cracks, etc. of the electrode members 8A, 8B and the electrode layers 7A, 7B caused by stress generated by a difference in coefficient of thermal expansion. This difference in coefficient of thermal expansion is caused by a difference between materials of the electrode members 8A, 8B and the electrode layers 7A, 7B. The electrode layers 7A and 7B are respectively arranged between the heating resistor 6 and the electrode members 8A and 8B. Accordingly, it is possible to stabilize contact resistances between the heating resistor 6 and the electrode members 8A and 8B.

Figure 4:
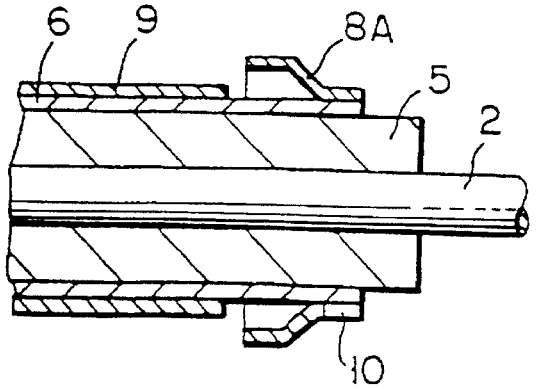
FIG. 4 is a partially broken cross-sectional view showing a modified example of the heating roller shown in FIG. 1.

In FIG. 4, the heating resistor 6 is extended except for the electrode layers 7A and 7B shown in FIG. 1 so that the electrode members 8A and 8B are directly mounted onto an outer circumference of the heating resistor 6. In such a construction, stress caused by the difference in coefficient of thermal expansion between the electrode members 8A, 8B and the heating resistor 6 can be absorbed by the electrode members 8A and 8B.

Some other embodiments of the heating roller in the present invention will next be explained. In the following description, constructional members similar to those in the first embodiment are designated by the same reference numerals as the first embodiment and an explanation of these constructional members is omitted. In the following embodiments, each of the carbon brushes 12A and 12B shown in FIG. 1 comes in slide contact with a member constituting an electrode member. An explanation of such contents is omitted in the following embodiments.

Figure 5:
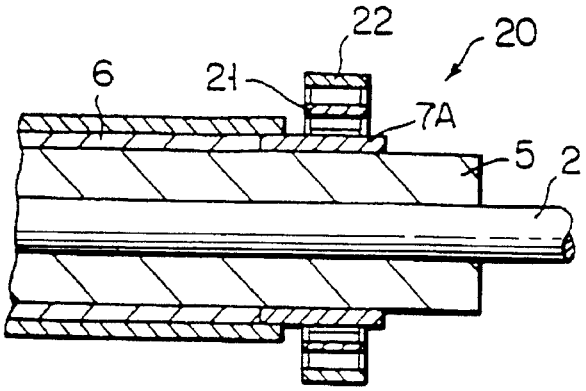
FIG. 5 is a partially broken cross-sectional view of a heating roller in accordance with a second embodiment of the present invention.

FIG. 5 shows a heating roller 20 in accordance with a second embodiment of the present invention. In this heating roller 20, electrode layers 7A and 7B are formed on an outer circumference of the core body 5 shown in the first embodiment. A leaf spring ring 21 as a resilient member having a conductive property is mounted onto each of the electrode layers 7A and 7B. Each of electrode rings 22 as an electrode member comes in contact with an outer circumference of this leaf spring ring 21. In FIG. 5, only one of the electrode rings 22 is shown.

Figure 6:
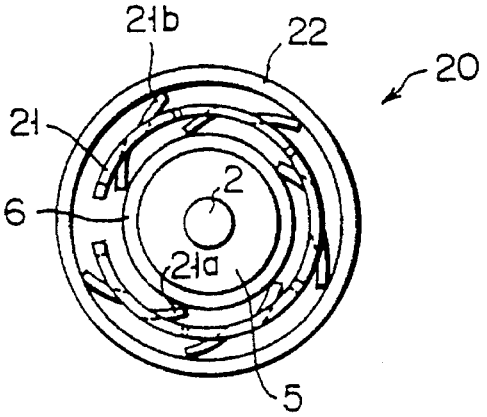
FIG. 6 is a cross-sectional view of the heating roller shown in FIG. 5.
Figure 7:
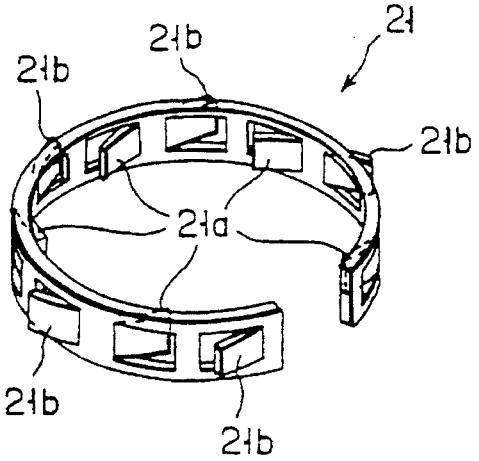
FIG. 7 is a perspective view showing a leaf spring ring as a resilient member.

As shown in FIGS. 6 and 7, the leaf spring ring 21 is formed in a C-shape in which projecting portions 21*a* and 21*b* respectively cut and rising inwardly and outwardly are alternated with each other. The projecting portion 21*a* is formed such that the projecting portion 21*a* is lowered on a left-hand side thereof to strongly come in press contact with the core body 5 when the core body 5 is rotated in the counterclockwise direction. In contrast to this, the projecting portion 21*b* is formed such that the projecting portion 21*b* is raised on a right-hand side thereof. Similar to the projecting portion 21*a*, when the core body 5 is rotated in the counterclockwise direction, the projecting portion 21*b* comes in press contact with the electrode ring 22.

Accordingly, when each of the core body 5 and the electrode ring 22 is thermally expanded, this expansion is absorbed by the leaf spring ring 21. Further, the core body 5 and the electrode ring 21 can be strongly held by elasticity of the leaf spring ring 21 when the core body 5 is rotated in the counterclockwise direction. Accordingly, rotating force of the core body 5 in the counterclockwise direction can be set to be strong. In this embodiment, the core body 5 is rotated in the counterclockwise direction so that the heating roller 20 is rotated in the counterclockwise direction. In contrast to this, when the heating roller 20 is rotated in the clockwise direction, inclinations of the projecting portions 21*a* and 21*b* can be set to be opposite to those in the above second embodiment so that similar effects can be obtained.

Figure 8:
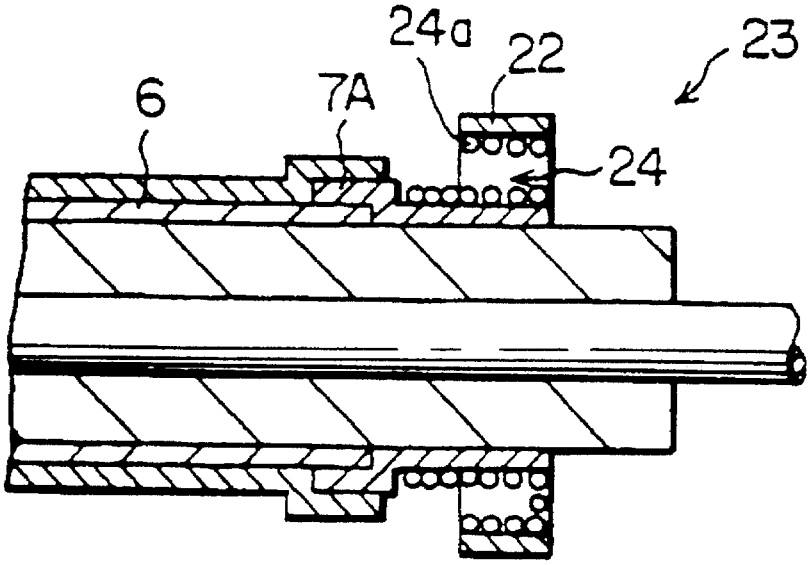
FIG. 8 is a partially broken cross-sectional view of a heating roller in accordance with a third embodiment of the present invention.

FIG. 8 shows a heating roller 23 in accordance with a third embodiment of the present invention. In this heating roller 23, a coil spring 24 instead of the leaf spring ring 21 shown in FIG. 5 is mounted between an electrode ring 22 and an electrode layer 7A. One end 24*a* of this coil spring 24 is fixed onto an inner side of the electrode ring 22. A winding direction of the coil spring 24 is set such that the coil spring 24 is wound and tightened in a rotating direction of the heating roller 23.

When the heating roller 23 is rotated, a contact pressure of the electrode layer 7A and the coil spring 24 is increased by setting the coil spring 24 as mentioned above so that large holding force can be obtained. Accordingly, the heating roller 23 can be rotated with large driving force.

Figure 12:
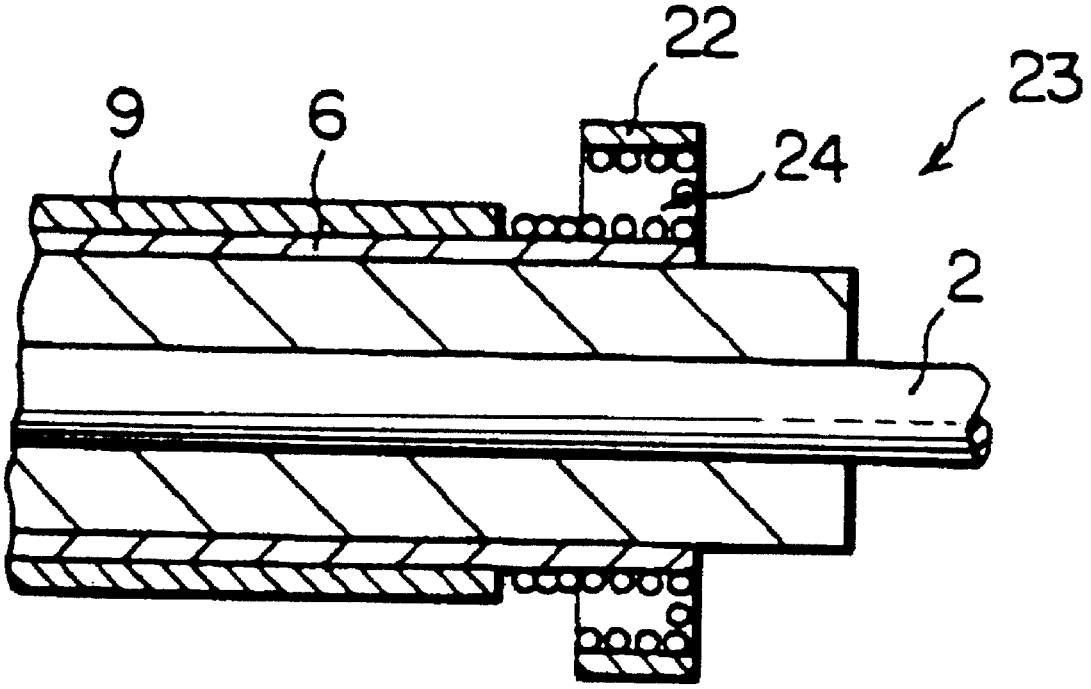
FIG. 12 is a partially broken cross-sectional view showing a modified example of the heating roller shown in FIG. 8.

In this embodiment, the coil spring 24 is wound around the electrode layer 7A. However, as shown in FIG. 12, the coil spring 24 may be directly wound around the heating resistor 6.

Figure 9:
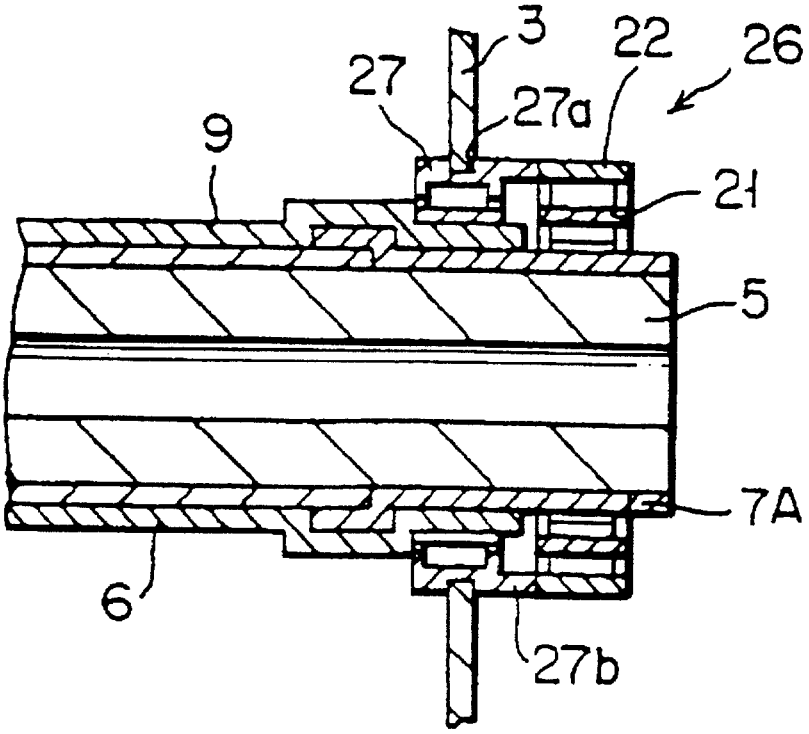
FIG. 9 is a partially broken cross-sectional view schematically showing the construction of a heating roller in accordance with a fourth embodiment of the present invention.

FIG. 9 shows a heating roller 26 in accordance with a fourth embodiment of the present invention. In this heating roller 26, a core body 5 is not supported by the shaft 2 in the first embodiment, but is used as a structural member. A Circumferential face of an insulting protective layer 9 is rotatably supported by a bearing 27 attached to a side plate 3.

Figure 10:
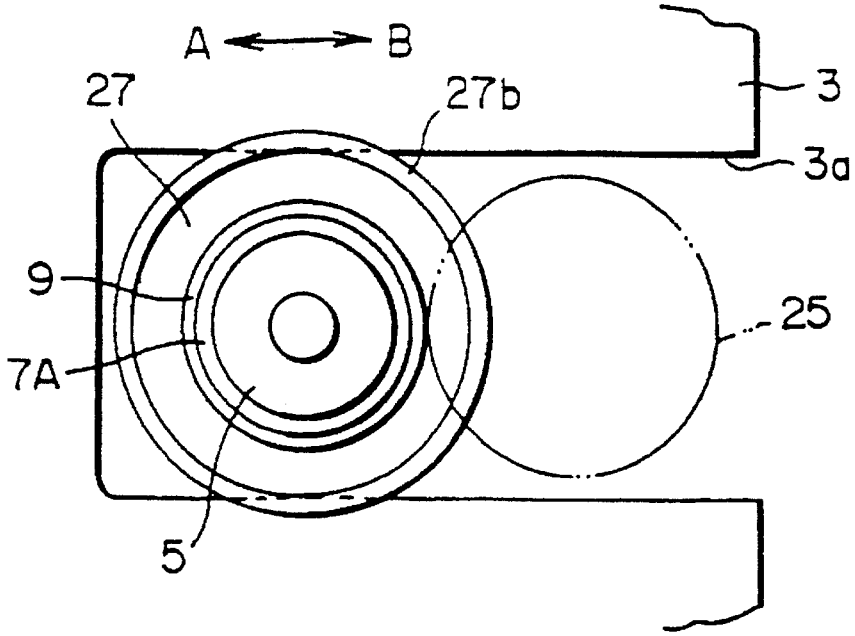
FIG. 10 is a cross-sectional view of the heating roller shown in FIG. 9.

A slit 27*a* is formed on an outer circumferential face of the bearing 27. An opening portion 3*a* formed in the side plate 3 and shown in FIG. 10 is fitted into this slit 27*a* with play. The heating roller 26 is slidably supported within this slit 27*a* in directions of arrows A and B perpendicular to an extending direction of the core body 5. A projecting portion 27*b* is formed on one side face of the bearing 27.

This projecting portion 27*b* comes in contact with an electrode ring 22 mounted onto an electrode layer 7A through a leaf spring ring 21. The electrode layer 7A covers an end portion of the core body 5 and is integrally engaged with a portion of a heating resistor 6. The projecting portion 27*b* restricts a movement of the electrode ring 22 in an axial direction. A backup roller 25 shown by a two-dot chain line in FIG. 10 is pressed against the heating roller 26 by an unillustrated spring. While the heating roller 26 is heated, an unillustrated sheet of paper attaching toner thereto passes between the heating roller 26 and the backup roller 25. Thus, the toner on the paper sheet is melted by heat of the heating roller 26 and is fixed onto this paper sheet by pressing force of the backup roller 25.

The core body 5 is made of ceramic, but it is generally difficult to process ceramic after the ceramic is molded. In this embodiment, the projecting portion 27*b* is formed in the bearing 27 so that the heating roller 26 can be positioned in the axial direction without processing the core body 5 made of ceramic. Accordingly, processing cost of the heating roller 26 can be restrained. Further, thermal expansion of each of the electrode ring 22 and the electrode layer 7A can be absorbed by the leaf spring ring 21.

Figure 11:
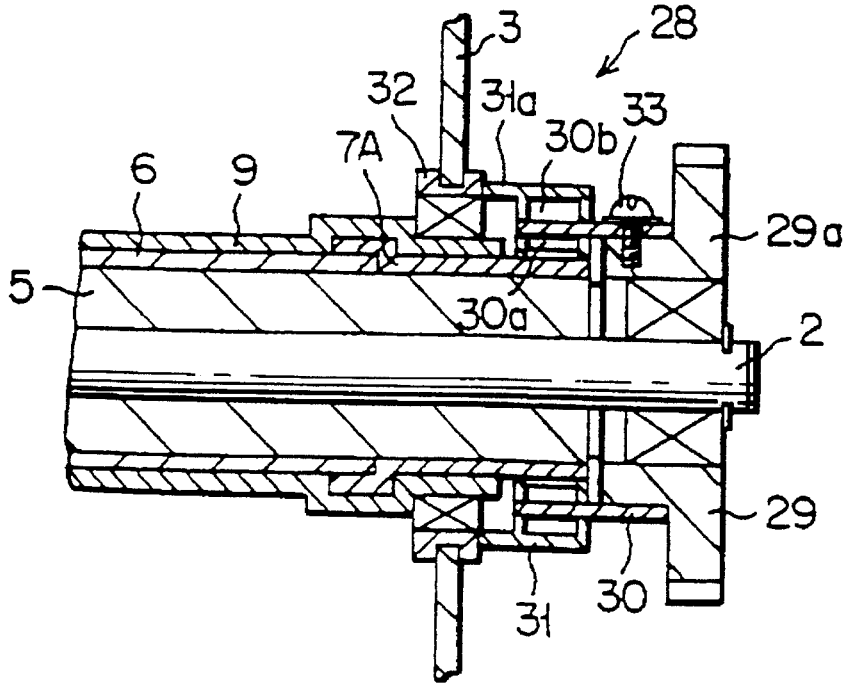
FIG. 11 is a partially broken cross-sectional view schematically showing the construction of a heating roller in accordance with a fifth embodiment of the present invention.

FIG. 11 shows a heating roller 28 in accordance with a fifth embodiment of the present invention. This heating roller 28 is obtained by further developing the heating roller 26 shown in FIG. 9 such that a driving gear 29 as a rotating force transmitting member is mounted to the heating roller 26. The driving gear 29 is rotatably supported at one end of a supporting shaft 2 extending through a core body 5. A leaf spring ring 30 is fixed to a boss portion 29*a* of the driving gear 29 by a screw 33. The leaf spring ring 30 is formed such that a width of the leaf spring ring 30 is wider than that of the leaf spring ring 21 used in each of the heating rollers 20 and 26 shown in FIGS. 5 and 9. The leaf spring ring 30 is integrated with the driving gear 29.

The leaf spring ring 30 is mounted onto an electrode layer 7A arranged at an end of the core body 5 by a projection 30*a* extending toward an inner side and a projection 30*b* extending toward an outer circumference, The leaf spring ring 30 resiliently supports an electrode ring 31. A projecting portion 31*a* is formed in the electrode ring 31 such that the projecting portion 31*a* comes in contact with a bearing 32 arranged on a circumferential face of an insulating protective layer 9. The projecting portion 31*a* positions the bearing 32 in an axial direction. The bearing 32 is attached to a side plate 3 so that the bearing 32 rotatably supports the heating roller 28.

In accordance with the heating roller 28 constructed above, the driving gear 29 can be mounted to the heating roller 28 without processing the core body 5 difficult to be processed. Further, a change in size of each of the electrode ring 31 and the electrode layer 7A caused by thermal expansion, etc. can be absorbed by the leaf spring ring 30. Further, the electrode layer 7A is interposed between a heating element 6 and the electrode ring 31 so that contact resistance of the electrode ring 31 and the heating element 6 can be stabilized.

As mentioned above, in accordance with the present invention, when an initial size of a heating resistor, an electric conductor or an electrode member is changed by thermal expansion, etc., this change in size can be absorbed by the electrode member resiliently fitted to the heating resistor and the electric conductor, or a resilient member arranged between the electrode member and the heating resistor or between the electrode member and the electric conductor. Therefore, it is possible to prevent cracks from being caused between the heating resistor and the electrode member, between the heating resistor and the electric conductor, or between the electric conductor and the electrode member. Accordingly, it is possible to provide a heating roller for reducing generation of a spark caused by discharge from a portion of cracks and the possibility of a conductive break.

Many widely different embodiments of the present invention may be constructed without departing from the spirit and scope of the present invention. It should be understood that the present invention is not limited to the specific embodiments described in the specification, except as defined in the appended claims.

What is claimed is:

1. A heating roller comprising:

a heating element;

an electrode member which comes in contact with a power supplying member for supplying power to said heating element and resiliently fitted to said heating element;

a bearing for rotatably supporting the heating roller having the heating element; and a structural member for supporting said bearing;

power being supplied to said heating element by the electrode member and the power supplying member, a movement of said heating roller in a thrust direction is restricted by making the electrode member resiliently fitted to said heating element come in contact with said bearing or said structural member.

2. A heating roller comprising:

a heating element; and an electrode member which comes in contact with a power supplying member for supplying power to said heating element and resiliently fitted to said heating element;

a bearing for rotatably supporting the heating roller having the heating element; and a structural member for supporting said bearing;

power being supplied to said heating element by the electrode member and the power supplying member, a movement of said heating roller in a thrust direction is restricted by making the conductive resilient member between the heating element and the electrode member come in contact with said bearing or said structural member.

3. A heating roller comprising:

a heating element;

a bearing for rotatably supporting the heating roller having the heating element;

a structural member for supporting said bearing; and a rotating force transmitting member arranged in an electrode member resiliently fitted to said heating element, or arranged in a resilient member having a conductive property between the heating element and the electrode member so that rotating force of the heating roller is obtained from the exterior thereof;

a movement of said heating roller in a thrust direction being restricted by making said structural member or said bearing come in contact with said electrode member or said resilient member.

4. A heating roller as claimed in claim 3, wherein the resilient member is constructed by a leaf spring or a coil spring.

5. A heating roller comprising:

a heating element;

a bearing for rotatably supporting the heating roller having the heating element;

a structural member for supporting said bearing; and a rotating force transmitting member arranged in an electrode member resiliently fitted to said heating element, or arranged in a resilient member having a conductive property between the heating element and the electrode member so that rotating force of the heating roller is obtained from the exterior thereof;

power being supplied from a power supplying member to said heating roller by interposing said electrode member.

* * * * *